US008099932B2

(12) United States Patent
Peacop et al.

(10) Patent No.: US 8,099,932 B2
(45) Date of Patent: Jan. 24, 2012

(54) MANDREL FOR DISPOSING A STRETCHABLE WRAPPER AROUND AN OBJECT

(75) Inventors: Alexander James Peacop, Devizes (GB); Martin Christopher Bunce, Pewsey (GB); William John Davis, Bath (GB); John David Lamb, Pewsey (GB); Peter Booth, Savernake (GB)

(73) Assignee: Imperial Chemical Industries PLC, London (GB)

( * ) Notice: Subject to any disclaimer, the term of this patent is extended or adjusted under 35 U.S.C. 154(b) by 504 days.

(21) Appl. No.: 11/578,445

(22) PCT Filed: Mar. 24, 2005

(86) PCT No.: PCT/EP2005/003308

§ 371 (c)(1), (2), (4) Date: Oct. 17, 2008

(87) PCT Pub. No.: WO2005/100168

PCT Pub. Date: Oct. 27, 2005

(65) Prior Publication Data

US 2009/0049806 A1 Feb. 26, 2009

(30) Foreign Application Priority Data

Apr. 14, 2004 (GB) ..... 0408371.3

(51) Int. Cl.
*B65B 53/00* (2006.01)

(52) U.S. Cl. ..... 53/441; 53/585

(58) Field of Classification Search ..... 53/441, 53/556, 176, 170, 582, 585, 590
See application file for complete search history.

(56) References Cited

U.S. PATENT DOCUMENTS

| | | | | |
|---|---|---|---|---|
| 2,976,661 | A * | 3/1961 | Bagnelle | 53/292 |
| 3,523,052 | A | 8/1970 | Bolen | |
| 3,846,901 | A | 11/1974 | Lovett | |
| 4,016,704 | A * | 4/1977 | Fujio | 53/399 |
| 4,144,631 | A * | 3/1979 | Fujio | 29/446 |
| 4,188,249 | A * | 2/1980 | Fujio | 156/165 |
| 4,208,237 | A * | 6/1980 | Heyne | 156/446 |
| 4,208,857 | A * | 6/1980 | Fujio | 53/585 |
| 4,806,187 | A * | 2/1989 | Fujisawa | 156/86 |
| 5,385,000 | A * | 1/1995 | Bakhtyari | 53/48.3 |
| 5,715,651 | A * | 2/1998 | Thebault | 53/399 |
| 6,925,777 | B2 * | 8/2005 | Fresnel | 53/399 |
| 2003/0111375 | A1 * | 6/2003 | Kilmartin | 206/459.5 |

FOREIGN PATENT DOCUMENTS

EP 1 388 496 2/2004

OTHER PUBLICATIONS

International Search Report, PCT Application No. PCT/EP2005/003308, dated Jul. 6, 2005.
International Preliminary Report on Patentability, PCT Application No. PCT/EP2005/003308, dated Oct. 19, 2006.

* cited by examiner

*Primary Examiner* — Paul Durand
(74) *Attorney, Agent, or Firm* — Kenyon & Kenyon LLP

(57) ABSTRACT

A mandrel (2) comprising a body portion (4) having an outer surface for receiving a stretchable closed wrapper (20), the mandrel having an end (6) adapted for mounting on a self supporting object (18) to be wrapped such that the wrapper can be slid over the mandrel and delivered therefrom onto the outer surface (22) of the object, in which the mandrel includes a portion which engages with the object to allow the mandrel to seat on an end of the object.

19 Claims, 4 Drawing Sheets

MANDREL FOR DISPOSING A STRETCHABLE WRAPPER AROUND AN OBJECT

CROSS-REFERENCE TO RELATED APPLICATION

This application is the national phase under 35 U.S.C. §371 of PCT International Application No. PCT/EP/2005/003308 having an International Filing Date of Mar. 24, 2005 entitled "A MANDREL FOR DISPOSING A STRETCHABLE WRAPPER AROUND AN OBJECT", which designated the United States of America, and was published in the English language as International Publication No. WO 2005/100168, and claims the benefit of priority to Great British Application No. 0408371, filed on Apr. 14, 2004. The disclosure of all of these applications is hereby incorporated in their entirety by reference.

This invention relates to a mandrel for fitting a stretchable closed wrapper to a self-supporting object capable of accepting a wrapper. The invention also relates to the use of such mandrel and a method of disposing the wrapper onto the object.

The invention finds particular, although not exclusive, application in disposing a label onto packaging for example cans (particularly paint cans) bottles and canisters.

When packaged goods are filled into cans on a manufacturing line (for example paint or food filled into cans), apparatus can conveniently be provided to dispose a label, for example an identification label, thereon. Sometimes packaged goods need to be re-labelled after they have been delivered to their point of sale. Such "in store re-labelling" as it is called is time consuming and difficult since it must be done by hand away from the manufacturing line, for example, at the premises from which the goods are being sold, or at a distribution centre.

Currently this operation is carried out by wrapping a flat label around the goods to form a sleeve and securing it to the goods with adhesive. Positioning the label on the goods in a way such as to resemble goods wrapped during manufacture is almost impossible. A major problem is aligning the wrapping with the goods in the same accuracy as can be achieved during manufacture.

In accordance with one aspect of the present invention, there is provided a mandrel comprising a body portion having an outer surface for receiving a stretchable closed wrapper, the mandrel having an end adapted for mounting on a self supporting object to be wrapped such that the wrapper can be slid over the mandrel and delivered therefrom onto the outer surface of the object, in which the mandrel includes a portion which engages with the object to allow the mandrel to seat on an end of the object.

Thus, in accordance with the invention, in-store re-labelling can be considerably improved when the label, consisting of a stretchable closed sleeve, is disposed on the packaging using the mandrel.

Advantageously, the surface of the mandrel has a generally frusto-conical upper portion flared outwardly into and terminating in a substantially cylindrical portion at its said one end.

The said one, lower end of the mandrel is advantageously of substantially the same shape as the top of the object on which it seats, for ease of transfer of the wrapper thereonto. Usually, this shaping will be cylindrical, but it is to be understood that this is not intended to be restricted to a right-cylindrical configuration, but may be of skew-cylindrical configuration. However, the object and co-operating mandrel need not necessarily be of circular cross section, for example being of oval cross section. Furthermore, the diameter of the cylindrical object need not be uniform along its length. For example, it may have a gradual taper, from one end to the other, or it may be wasted. Furthermore, the object and the co-operating portion of the mandrel may be of rectilinear cross-section, for example square, rectangular or triangular (preferably with rounded corners).

The upper portion of the mandrel is advantageously slightly bowed outwardly, so as to provide a smoothly curving surface that merges into a, preferably, generally cylindrical lower portion at said one end thereof.

The mandrel of the invention thus allows a wrapper, which may be provided as a labelling sleeve, to be fitted easily over the narrower end of the upper portion, and then gradually slid, for example manually, so as to reach its other, end of the lower portion. This may be done before or after the mandrel has been mounted on the object. Subsequent to mounting the mandrel on the end of the object, sliding of the wrapper may be continued to transfer the wrapper from the mandrel, so as to dispose the entire length of the wrapper securely on and in conformity with the outer surface of the object.

The mandrel may be substantially hollow, with the said shaping of the inner surface being located partway along its length so as to allow the mandrel to sit on and around the object, thereby facilitating transfer of the wrapper.

Advantageously, the inner surface is provided with one or more, and preferably four, inwardly-directed projections circumferentially-spaced therearound, to allow a stable mounting of the mandrel on the object. The projections may be formed by indenting the outer surface of the hollow mandrel.

The mandrel may conveniently be made by moulding, for example of a plastics material.

It will be apparent that the mandrel may be used repeatedly so as to dispose successive wrappers onto a series of cylindrical objects.

In accordance with another aspect of the invention, there is provided the use of an expansion mandrel according to said one aspect of the invention, wherein the mandrel is seated on an end of an object of circumference substantially equal to that of the lower portion of the mandrel, wherein a stretchable closed wrapper defining a circumference slightly less than the circumference of the object (i) is urged over the smaller end of the mandrel, (ii) is slidably urged along the entire length of the mandrel, thereby being transversely stretched, and (iii) is slidably urged off the mandrel so as to relax onto the adjacent outer surface of the object in conformity therewith.

In accordance with a further aspect of the present invention, there is provided a method of disposing a closed, stretchable wrapper around the outer surface of an object of wherein a mandrel according to the said one aspect of the invention is seated on an end of the object, whose circumference is substantially equal to that of the lower portion of the mandrel; wherein the wrapper defines a circumference that is slightly less than that of the lower portion of the mandrel; and wherein the wrapper (i) is urged over the smaller end of the upper portion of the mandrel, (ii) is slidably urged along the entire length of the mandrel, thereby being transversely stretched, and (iii) is slidably urged off the mandrel so as to relax onto the adjacent outer surface of the object in conformity therewith.

The, preferably substantially cylindrical, object may be a paint can, and the wrapper may form a labelling sleeve, carrying identification and other information relating to the contents, supplier, etc of the paint.

According to another aspect of the present invention there is provided an expansion mandrel comprising a body portion having an outer expansion surface for receiving a stretchable closed wrapper, the expansion surface flaring outwardly toward one end of the mandrel, that end being adapted for mounting on a self supporting object to be wrapped such that the wrapper can be slidably expanded over the mandrel and delivered therefrom onto the outer surface of the object, wherein the mandrel has an inner surface shaped so as to allow the mandrel to seat on an end of the object.

A mandrel, and its method of use, will now be described, by way of example, with reference to the accompanying drawings, in which.

Figure 1:
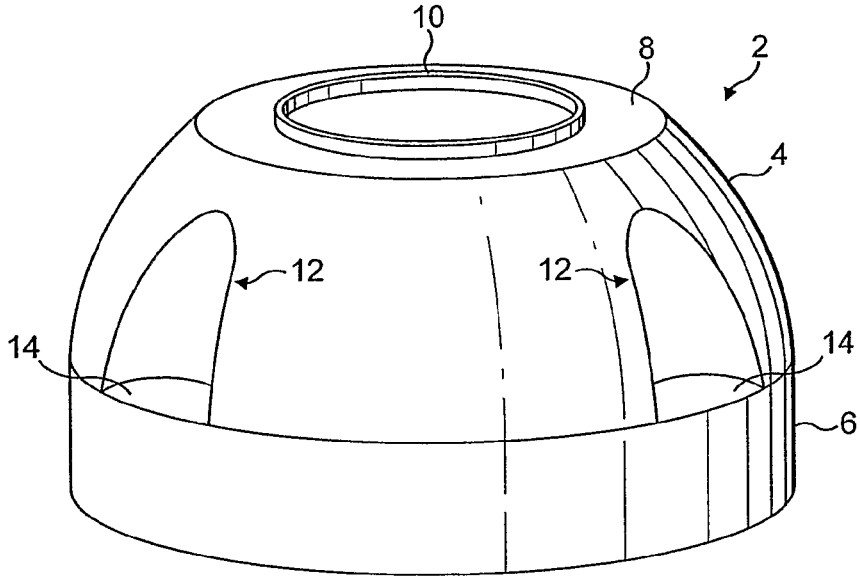
FIG. 1 is a perspective view from one side and above of the mandrel.

Referring to the drawings, a mandrel 2 comprises a hollow body that has a generally curved frusto-conical upper portion 4 that smoothly merges into a lower right-cylindrical portion 6. Its planar upper surface 8 is delimited by an upstanding flange 10.

The mandrel 2 is hollow and moulded from a plastics material, with four indentations 12 in its upper portion 4 adjacent the lower portion 6. The indentations 12 are equispaced around the circumference of the mandrel 2, and are formed in the mould so as to leave four semi-circular planar surfaces 14 projecting inwardly of the mandrel 2 in a common plane that is substantially perpendicular to the central axis of the mandrel 2.

Figure 3:
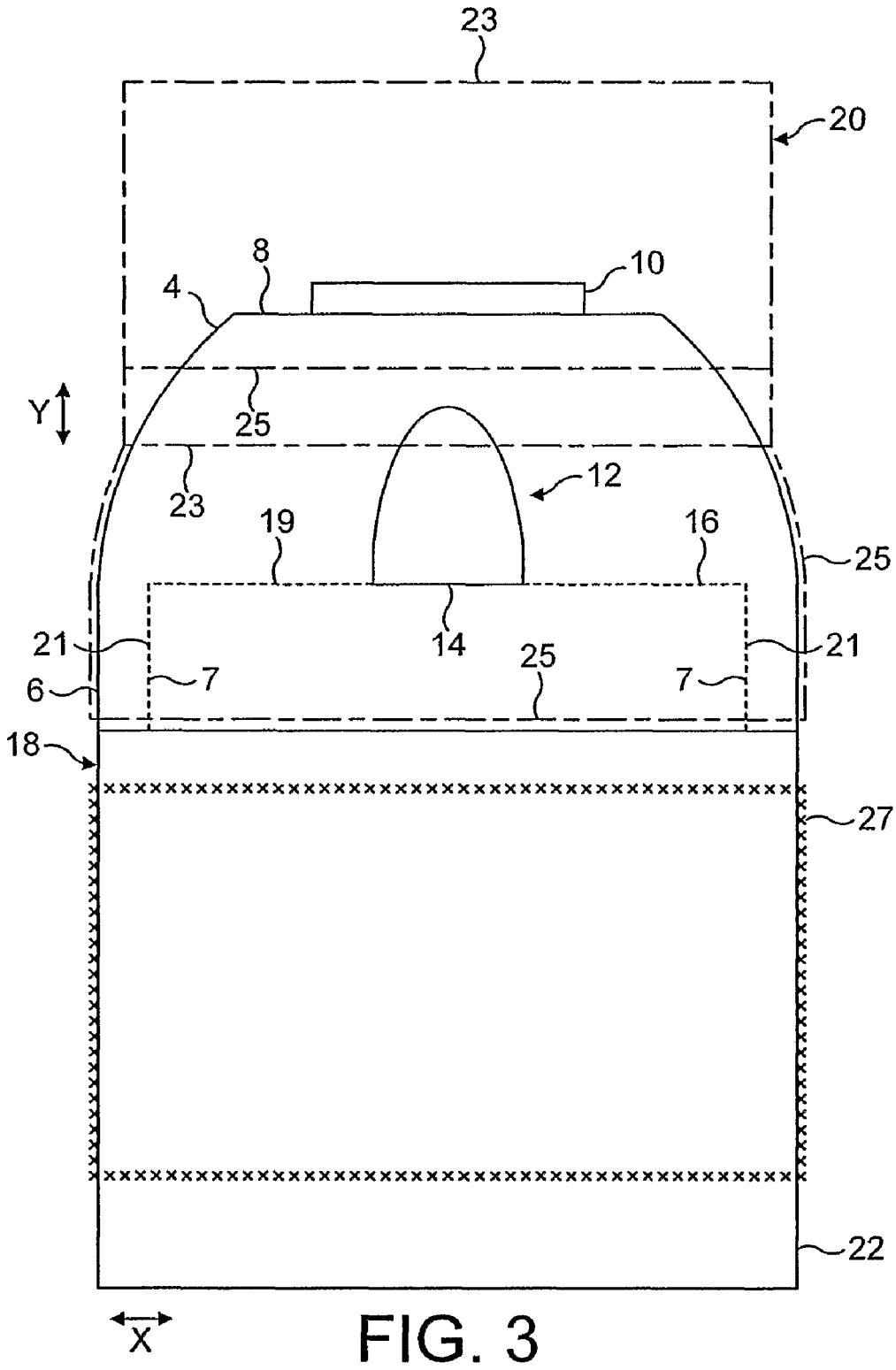
FIG. 3 is an elevation of the mandrel from another side showing the installation of a wrapper thereon.

As shown in FIG. 3, the mandrel 2 is sized such that the lower portion 6 can sit on and locate around the annular rim 16 of an object in the form of a right-cylindrical paint can 18 of substantially the same outer diameter, so as to form a continuous cylindrical outer surface that merges into the frusto-conical upper portion 4 of the mandrel 2.

In operation, a flimsy, stretchable, plastics labelling sleeve 20 is required to be disposed on the cylindrical outer surface 22 of the can 18, and is itself provided as a closed wrapper. The diameter of the wrapper 20 in its unstretched state is slightly less than the diameter of the outer surface 22 of the paint can 18, and is such that it can freely sit over part of the frusto-conical surface of the upper portion 4 of the mandrel 2 before engaging therewith, as shown by the broken outline 23 in FIG. 3. The lower edge of the label 20 can then be forced down, along and outwards over the upper mandrel portion 4 so as to be stretched and located as a tight fit around the lower portion 6, to be secured thereon and to lie in the position as shown in the chain dotted line 25. It will be appreciated that the label 20 may be fitted onto the mandrel 2 prior or subsequent to the mandrel 2 being mounted on the paint can 18.

With the mandrel 2 in position on the paint can 18 and the label 20 in the position of chain dotted line 25, further downward pressure on the label 20 around its lower edge will slide the label 20 completely over and off the mandrel 2 and allow it to relax and thus fit tightly and conformably in its required final location around the outer surface 22 of the can 18. The mandrel 2 can then be freely removed.

It will be appreciated that the mounting of the label 20 onto the mandrel 2 and its subsequent transfer on to the paint can 28 can be done conveniently and manually, once the mandrel 2 has been positioned so that it seats on the can 18. By providing a mandrel which is portable, the mandrel can be easily transferred to the location of the paint can, for example, in a retail outlet, and then positioned on the paint can to enable the label to be transferred onto the paint can. The fact that the mandrel positively seats on the paint can enables the mandrel to be manipulated with the paint can as the label is transferred onto the paint can and provides stability to the process.

It can be seen from FIG. 3 that the mandrel 2 is located longitudinally (direction Y when viewing FIG. 3) relative to the paint can 18 by engagement between the planar surface 14 of the indentations 12 and an upper surface 19 of the rim 16 of the paint can 18.

The mandrel 2 is located laterally (direction X when viewing FIG. 3) by engagement between an inside surface 7 of the lower portion 6 of the mandrel and a side surface 21 of the rim 16 of the paint can 18.

It can also be seen from FIG. 3 that the lower portion 6 of the mandrel 2 locates around the rim 16 of the paint can 18.

Figure 2:
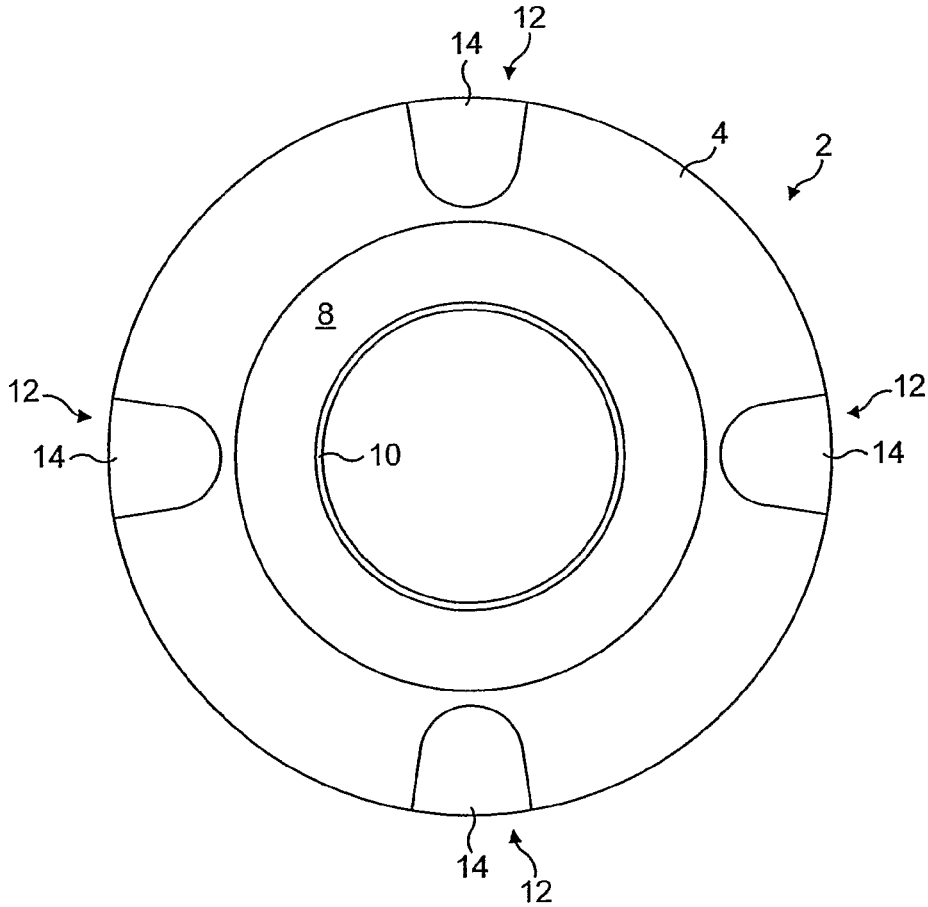
FIG. 2 is a plan view of the mandrel of FIG. 1 from above.
Figure 4:
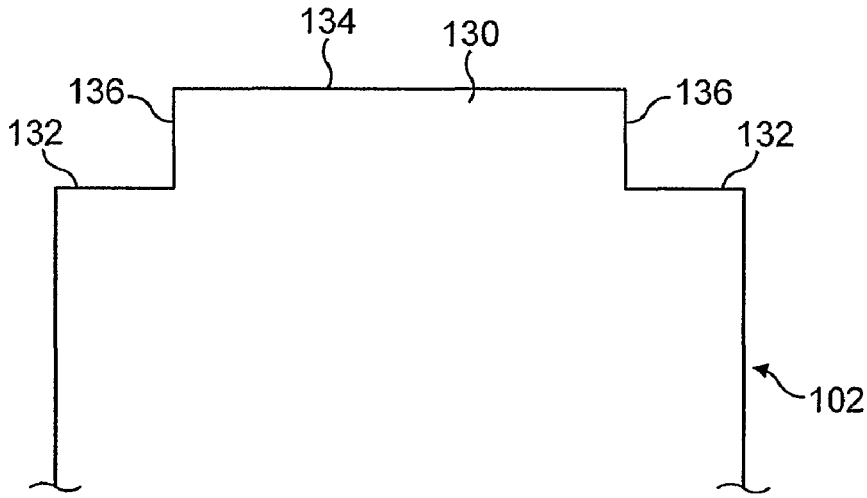
FIG. 4 is an elevation of an alternative mandrel.

With reference to FIG. 4 there is shown an alternative mandrel 102 which differs from the mandrel shown in FIGS. 1 to 3 in that it locates inside the base of a paint can as opposed to around the rim of a base can as described below.

Mandrel 102 has a cylindrical projection 130 extending from its upper end, the projection 130 having an outer side surface 136 and an upper surface 134. The mandrel has an upper surface 132.

Figure 5:
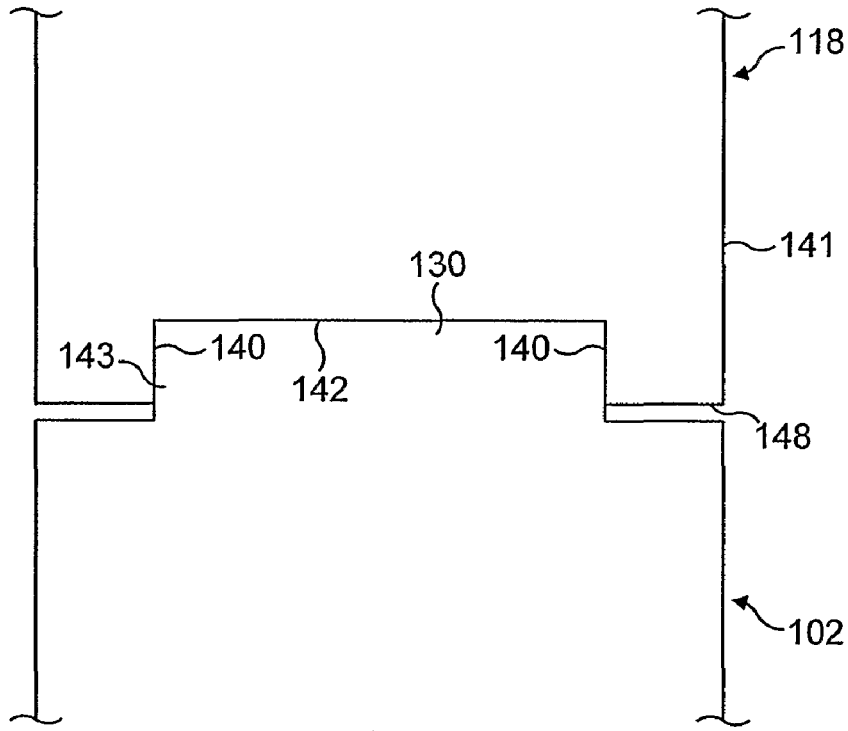
FIG. 5 is an elevation of the mandrel of FIG. 4 located relative to a paint can.

With reference to FIG. 5, the mandrel is shown (without a label) located within part of an alternative paint can 118. The paint can 118 has a base 141 which includes a cylindrical recess 143 defined by inner surface 140 and lower surface 142.

It can be seen from FIG. 5 that the mandrel 102 is located longitudinally relative to the paint can 118 by engagement between the upper surface 134 of the projection 130 and the lower surface 142 of the paint can 118. In an alternative embodiment the longitudinal location could be achieved by engagement between a lower surface 148 of the paint can and the upper surface 132 of the mandrel.

The mandrel 102 is located laterally by engagement between the inner surface 140 of the paint can 118 and the outer side surface 136 of the mandrel 102.

It can be seen from FIG. 5 that the portion of the mandrel locates inside rather than around the paint can, and that this is because the portion which locates the mandrel relative to the object is the projection 130 rather than the inside surface.

It can also be seen from FIG. 5 that the mandrel is located below the paint can, and that the label (not shown) is pulled upwards onto the paint can as opposed to downwards in the embodiment of FIGS. 1 to 3.

In an alternative embodiment the projection need not be cylindrical, and could for example be part-spherical, or indeed any shape providing the corresponding recess in the paint can enables the shape to be received.

The mandrel may also include more than one projection which locates inside a single recess in the paint can, or each projection could locate inside a corresponding recess in the paint can.

Figure 6:
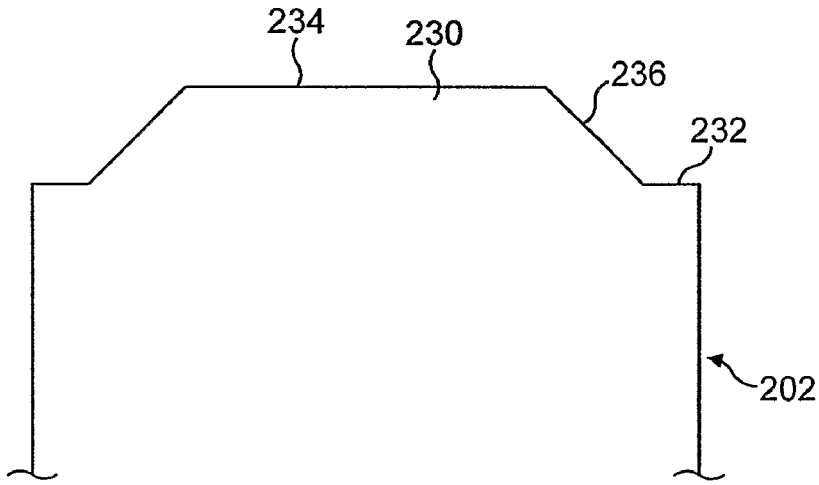
FIG. 6 is an elevation of an alternative mandrel.

With reference to FIG. 6 there is shown an alternative mandrel 202 which differs from the mandrel shown in FIGS. 4 and 5 as described below.

Mandrel 202 has a projection 230 extending from its upper end, the projection 230 having an outer side surface 236 and an upper surface 234. The mandrel has an upper surface 232. It can be seen from FIG. 5 that, in contrast to the mandrel of FIGS. 4 and 5, the outer side surface 236 is tapered.

Figure 7:
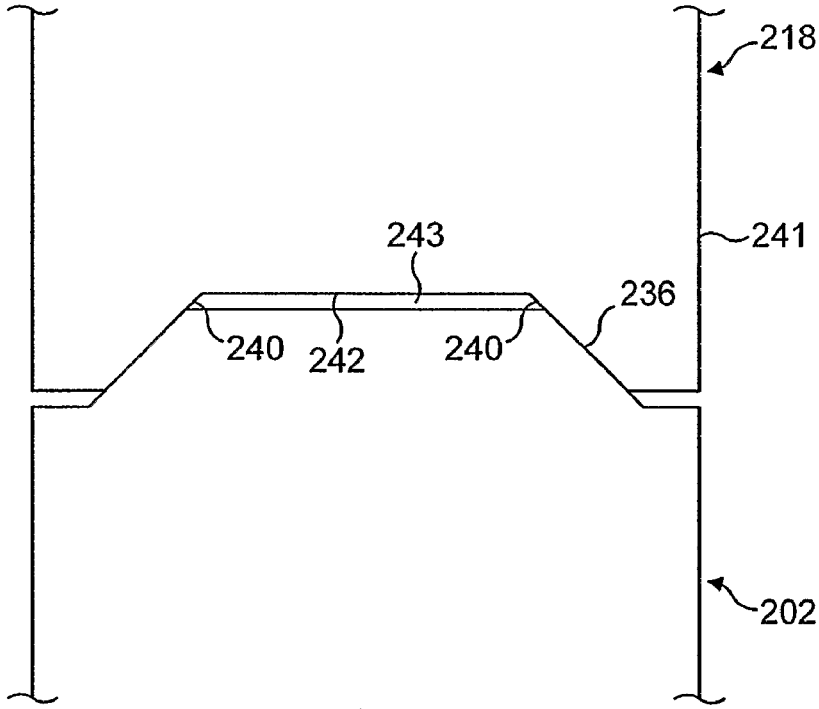
FIG. 7 is an elevation of the mandrel of FIG. 6 located relative to a paint can.

With reference to FIG. 7, the mandrel is shown (without a label) located within part of an alternative paint can 218. The paint can 218 has a base 241 which includes a recess 243 defined by inner surface 240 and lower surface 242. It can be seen from FIG. 7 that the inner surface 240 is tapered.

It can be seen from FIG. 7 that the mandrel 202 is located both laterally and longitudinally relative to the paint can 218 by engagement between the outer side surface 236 of the mandrel 202 and the inner surface 240 of the paint can 218. The tapered nature of the engaging surfaces enables both lateral and longitudinal location without the need for discrete surfaces.

In the embodiments of FIGS. 1 to 7 the mandrel has a diameter which is substantially the same as the diameter of the portion of the paint can which sits adjacent the mandrel, and thus the wrapper is stretched as it passes over the mandrel and onto the paint can. In an alternative embodiment, the mandrel can have a diameter which is smaller than that portion of the paint can diameter, and thus smaller than the wrapper diameter, so as to enable easier transfer of the wrapper from the mandrel onto the paint can. In this case, the wrapper is not stretched on the mandrel, the mandrel is merely acting as a guide for the label, with the wrapper being stretched by the paint can itself.

It will thus be appreciated that the mandrel of the present invention can be used in-situ at a customer's location, for example, where the customer has been supplied with a batch of paint cans, for example, already filled and sealed by the manufacturer; the customer then being able to fit his own identifying labels as appropriate. This allows convenient mass production of the filled and sealed cans by the manufacturer, whereby different customers may provide their own identifying labelled wrapper onto the cans.

The invention claimed is:

1. A mandrel comprising:

a) a body portion having an outer surface for receiving a stretchable closed wrapper, b) an end adapted for mounting on a self supporting object to be wrapped such that the wrapper can be slid over the mandrel and delivered therefrom onto the outer surface of the object, and c) an engaging portion which engages with the object to allow the mandrel to seat on an end of the object, wherein the engaging portion locates the mandrel both laterally and longitudinally relative to the object, and is defined by a lower surface and a tapered inner surface which locates the mandrel both laterally and longitudinally relative to the object, and wherein the inner surface is shaped selected from i) so as to allow the mandrel to seat on the end of the object, or ii) where its lower portion at said one end is locatable around the object, and the inner surface is affected by one or more inwardly directed projections, which are formed by indentations of the outer surface thereof, and which locate the mandrel longitudinally relative to the object.

2. A mandrel according to claim 1 in which the outer surface has a diameter which is greater than that of the wrapper, such that the wrapper can be slidably expanded over the mandrel.

3. A mandrel according to claim 1 wherein four of said inwardly directed projections are provided, substantially equi-spaced around the inner surface.

4. A mandrel according to claim 3 wherein the inwardly directed projections are formed by indentations of the outer surface thereof.

5. A mandrel according claim 1 in which the engaging portion is able to locate the mandrel relative to the object laterally or longitudinally or both.

6. A mandrel according to claim 5 wherein the engaging portion locates the mandrel both laterally and longitudinally relative to the object and is shaped to include a stepped profile having a first surface to locate the mandrel laterally relative to the object, and a second surface to locate the mandrel longitudinally relative to the object.

7. A mandrel according claim 1 in which the engaging portion is able to locate the mandrel relative to the object laterally or longitudinally or both.

8. A mandrel according to claim 7 wherein the engaging portion locates the mandrel both laterally and longitudinally relative to the object and is shaped to include a stepped profile having a first surface to locate the mandrel laterally relative to the object, and a second surface to locate the mandrel longitudinally relative to the object.

9. A mandrel according to claim 1 in which the engaging portion of the mandrel is at least partly defined by a projection.

10. A mandrel according to claim 1 in which the outer surface flares outwardly towards one end.

11. A mandrel according to claim 1, formed as a substantially hollow shell.

12. A mandrel according to claim 1, wherein said one end thereof is of substantially cylindrical or rectilinear configuration.

13. A mandrel according to claim 1, wherein the outer surface of the mandrel has a generally frusto-conical upper portion flared outwardly into and terminating in a substantially cylindrical portion at its said one end.

14. A mandrel according to claim 1, formed by molding of plastics material.

15. A mandrel according to claim 1 in which the mandrel is portable thereby enabling a wrapper to be applied remote from a manufacturing line.

16. A mandrel according to claim 1, and in addition at least one closed, stretchable wrapper, sized to be a stretch fit onto the mandrel over the flared surface thereof.

17. A mandrel and wrapper according to claim 16, wherein the wrapper is in the form of a labelling sleeve that is made of plastic.

18. A method of disposing a closed, stretchable wrapper around the outer surface of an object, comprising:

seating the mandrel of claim 1 on an object of circumference substantially equal to that of a lower portion of the mandrel, wherein a stretchable closed wrapper defining a circumference slightly less than the circumference of the object (i) is urged over the smaller end of an upper portion of the mandrel, (ii) is slidably urged along the entire length of the mandrel, thereby being transversely stretched, and (iii) is slidably urged off the mandrel so as to relax onto the adjacent outer surface of the object in conformity therewith.

19. A method according to claim 18 in which the object has a base upon which it sits in normal use, and the mandrel is seated on the base of the object.

* * * * *